United States Patent [19]

Youdelis

[11] 4,224,070

[45] Sep. 23, 1980

[54] CHLORIDE SALT-SILICON CONTAINING SLAG COMPOSITIONS FOR CAST IRON MELTS

[76] Inventor: William V. Youdelis, 1935 W. Grand Blvd., Windsor, Ont., Canada, N9E 1G6

[21] Appl. No.: 21,875

[22] Filed: Mar. 19, 1979

[51] Int. Cl.[2] ..... C22B 9/10

[52] U.S. Cl. ..... 75/257; 75/53

[58] Field of Search ..... 75/257, 53, 130 R, 24, 75/129, 130 AB

[56] References Cited

U.S. PATENT DOCUMENTS

| | | | |
|---|---|---|---|
| 2,750,284 | 6/1956 | Ihrig | 75/130 AB |
| 3,415,642 | 12/1968 | Matsumoto | 75/130 R |

*Primary Examiner*—P. D. Rosenberg

*Attorney, Agent, or Firm*—Beveridge, DeGrandi, Kline & Lunsford

[57] ABSTRACT

A slag composite formed of chloride salts and silicon or a silicon alloy applied to the surface of magnesium-inoculated cast iron melts retards magnesium fade from the melt.

10 Claims, 3 Drawing Figures

CHLORIDE SALT-SILICON CONTAINING SLAG COMPOSITIONS FOR CAST IRON MELTS

Figure 1A:
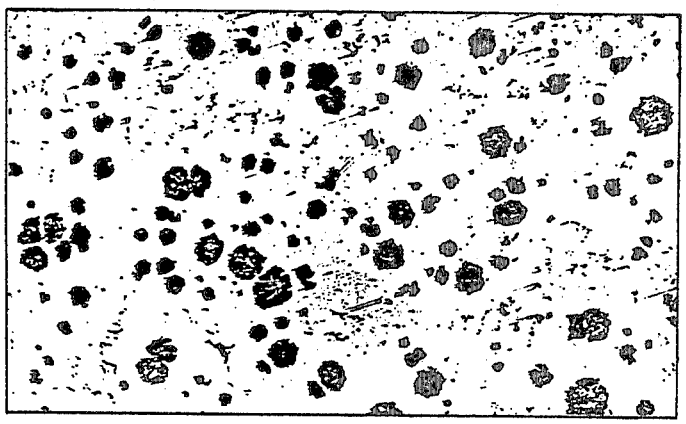

The present invention relates to slag compositions which prevent or retard the loss of magnesium from cast iron melts. The slags are essentially composites of chloride salts with silicon or ferrosilicon alloys, and are applied in powder or aggregate form to the surface of magnesium-inoculated cast iron melts.

"Ductile iron" is cast iron in which carbon is present as graphite nodules dispersed throughout a soft iron matrix, and is frequently referred to as "nodular" or"spheroidal graphite iron". The tensile strength of such type of iron is considerably higher than that of "grey cast iron" in which the carbon is present in the form of graphite flakes which act to disrupt the continuity of the iron matrix.

The nodularization or spherodization of the graphite may be attained by incorporating magnesium into a cast iron melt. The mechanism by which magnesium spherodizes the graphite is not clearly understood; however, a small but definite amount of magnesium is essential for the formation of graphite nodules. Several alkali metals, alkaline earths, and rare earths (e.g. rubidium, barium, strontium, cerium, etc), will also spherodize the graphite to varying degrees and one or more of these may be added in place of or in conjunction with magnesium. Magnesium is, however, the most widely used nodularizer in the cast iron industry due principally to its generally lower cost and greater effectiveness.

The degree of sphericity of the graphite (nodularity) as well as the nodule count (particle density per unit volume) is dependent on the amount of magnesium present. Small amounts of aluminum, calcium, strontium and other rare earth elements, when present in conjunction with magnesium, are believed to increase the nucleation rate of graphite nodules and are frequently added for this purpose. If the graphite nodule count is too low the remaining carbon will precipitate as iron carbide, and if iron carbide is present in appreciable amounts the cast iron becomes hard and brittle, and is referred to as "white cast iron" due to its fracture characteristics. The precipitation of carbon as a carbide rather than in graphite form increases with the cooling or solidification rate of the casting.

The inoculation of cast iron melts with magnesium and other inoculating elements such as cerium, aluminum, and calcium is usually accomplished by the addition to the cast iron melt of ferrosilicon alloys containing the above elements. The role of the ferrosilicon is essentially that of a carrier for the above highly reactive metals, and ferrosilicons used for this purpose are known as nodularizing or inoculant alloys. Most commercially available inoculant alloys ae ferrosilicons containing from 2 to 10% by weight magnesium, with some containing as high as 25% by weight magnesium.

Incorporating and retaining magnesium in cast iron melts is a very difficult and troublesome problem in the foundry industry. This is due to magnesium's relatively low boiling point and high vapor pressure at foundry operating temperatures 81350–1500° C.), resulting in rapid volatilization of magnesium from the melt along with a corresponding decrease in nodularity and nodule count for the cast iron. This phenomenon is known in the foundry industry as "magnesium fade" and "inoculant fade". Good to excellent nodularity results when a (residual) magnesium level of about 0.03 to 0.05% by weight is obtained in the cast iron. When the magnesium drops to about 0.01% and lower the degree of nodularity deminishes to unacceptable levels with the graphite utimately reverting to a flake form. On the other hand, if the residual magnesium level exceeds about 0.15 to 0.20% the graphite nodules become spiky and there is a corresponding drop in tensile strength of the cast iron from its maximum possible value.

To overcome the fade problem the usual foundry practice is to inoculate the cast iron melt with an excess of magnesium and to cast the melt as soon as possible after inoculation. The maximum holding time permitted will vary depending on the particular foundry practice (i.e. iron chemistry, furnace temperature and size, inoculant alloy composition, casting method, etc.), but it is generally from 2 to 3 minutes and rarely exceeds 10 minutes. For example, one published report shows that half of the magnesium is lost within 5 to 6 minutes after inoculation, and that after 15 minutes the residual magnesium level drops to 0.015% and lower (c.f M. Robinson, AFS Trans., 1976, Vol. 84, page 585). To obtain optimum nodularization some foundries inoculate directly in the mold or the metal stream as it enters the mold (referred to as inmold and instantaneous ladle inoculation) in attempts to virtually eliminate the holding time with correspondingly reduced magnesium fade. The inmold and instantaneous ladle inoculation methods however introduce other problems, in particular, the tendency for incomplete dissolution of the inoculant alloy due to insufficient reaction time and the lack of uniformity in the distribution of magnesium throughout the casting.

The benefits to the cast iron foundry industry would be substantial if magnesium fade could be prevented or significantly retarded. One immediately obvious benefit would be the increase in the allowable holding time after inoculation. Thus more or longer interruptions in the casting phase could be accommodated without risking the necessity of scrapping the metal due to insufficient nodularity resulting from the loss of magnesium during the holding time.

The primary object of the present invention is to provide a simple and economical means by which magnesium loss from magnesium-inoculated cast iron melts is prevented or significantly retarded. Another object of this invention is to provide novel slag compositions which, when applied to the surface of magnesium-inoculated cast iron melts, prevent or markedly reduce the rate of magnesium fade in the cast iron.

I have now developed slags for cast iron melts which significantly retard the rate of loss of magnesium. The application of my slags to inoculated cast iron melts enables good nodularity to be maintained for holding times of at least 30 minutes or longer at operating temperatures exceeding 1500° C.

The slags of my invention are composites consisting essentially of chloride salt and silicon or ferrosilicon base alloy mixtures. The preferred salt constituent of my slags is barium chloride ($BaCl_2$), but calcium chloride ($CaCl_2$) and mixtures of barium chloride and calcium chloride are also effective. Barium chloride is less volatile than calcium chloride and is thus more suitable for higher foundry operating temperatures. I have found that sodium chloride (NaCl), although miscible with either barium chloride or calcium chloride, vaporizes too readily at the operating temperatures involved, resulting in copious fuming of the slag to the detriment of the enviroment and the slag's protective effectiveness. The preferred silicon alloy constituent of my slags is a ferrosilicon base alloy containing about 50 to 60% by weight silicon and about 5% by weight magnesium. The melting point of the preferred ferrosilicon base alloy (approx. 1220° C.) is considerably below that of silicon (approx. 1430° C.) or the high iron content ferrosilicons, and therefore slags containing the preferred ferrosilicon base alloy maintain good fluidity and homogeneity at lower operating temperatures. Slags containing as little as 5% by weight silicon, incorporated into the composite either as pure silicon or as a ferrosilicon base alloy, will, however, provide acceptable protection against magnesium fade for the cast iron melts.

While not being confined to any theory, the slags of my invention appear to provide a magnesium absorbing and retaining medium that exert a magnesium "back pressure" to counter the magnesium vapor pressure of the melt, thereby preventing or significantly retarding the rate of magnesium volatilization from the melt. The ferrosilicon base alloy constituent, when used may also contain magnesium for this purpose. Commercial ferrosilicon base alloys containing up to 25% by weight are available and may be used in the slag. I have, however, found that composites containing no magnesium in the silicon alloy constituent produce slags that also provide good protection against magnesium fade. It appears to be evident that the silicon or ferrosilicon alloy constituent in the slag acts to absorb magnesium from the melt, thereby developing a magnesium potential or "back pressure". It might be noted that if there is very little slag relative to the total amount of cast iron melt the amount of magnesium transfer from the melt to the slag is small.

The silicon or ferrosilicon base alloy constituent of the slag composite may contain other elements besides magnesium that are known to promote nodularization of the graphite, e.g. aluminium, strontium, cerium are frequently contained in commercial ferrosilicon base alloys. I have, however, found that the presence of these other elements in the ferrosilicon or silicon alloy constituent of the slag do not act to significantly improve the effectiveness of the slag in preventing or retarding the rate of magnesium fade.

If the salt constituent of the slag is essentially barium chloride, calcium in the silicon or ferrosilicon constituent (usually present as calcium silicide) of the slag should be absent or kept at least to low levels, as calcium reduces the barium chloride at the melt temperatures involved and thereby tends to destroy the continuity of the slag. I have found that silicon alloys containing as low as 14% by weight calcium effectively prevented the formation of a lasting continuous and uniformly dense slag layer on the metal surface. The reduction of barium chloride by calcium metal or calcium silicide is the basis of the process disclosed in Canadian Pat. No. 537,980, wherein calcium silicide, barium chloride and molten metal are brought together for the purpose of reducing the barium chloride so that the released barium is incorporated into the metal and acts as the nodularizing agent. My slags have no significant nodularizing potential, and the effectiveness of the present slag in preventing or retarding the rate of magnesium fade from prior-inoculated cast iron melts depends on providing and maintaining a continuous, protective slag layer over the metal surface. It is essential, therefore, that elements which tend to reduce the chloride salt be absent in the silicon or ferrosilicon alloy constituent of the slag composite, or kept at low ineffectual levels.

The slag compositions of the present invention are also fundamentally different from those proposed by Loricchio in U.S. Pat. No. 3,704,230. The compositions taught by Loricchio are concerned with exothermic compositions, i.e. to slag composition which will dissociate and thereby provide heat to the metal in a mold. The major constituent of Loricchio is silicon carbide, which decomposes to Si and C in the presence of the provided catalyst (such as lead dioxide, potassium dichromate or lead chromate) and also iron. The Si and C in turn react with the chloride salt resulting in decomposition of the salt. In view of this latter reaction silicon carbide should not be employed as a source of silicon for the compositions of the present slag.

The chloride salt constituent of my slag composite serves two principal functions; it rapidly liquifies on contact with the high temperature melt, uniformly spreading and retaining the silicon or ferrosilicon alloy particles (which also melt but at a slower rate as the silicon or ferrosilicon alloy particles have higher melting temperatures than the chloride salt) over the surface of the melt, and secondly, it also provides oxidation protection for the silicon and ferrosilicon alloy components which are highly reactive. The higher the chloride salt to silicon alloy ratio for the composite the more fluid the slag but the less its magnesium retaining ability. Slags which contain up to 95% chloride salt have been found to be effective and in addition I have found that slags comprising only 10% weight of chloride salt will provide protection for the cast iron melt; however, for adequate slag fluidity a chloride salt to silicon alloy weight ratio of about 1:1 and up to 2:1 is preferred. I have further found that there is no significant difference in the ability of the slag to prevent or retard magnesium fade from the cast iron melt whether it is prepared as a powder composite by mixing powders of the chloride salts and silicon alloys, or fusing mixtures of chloride salt and silicon alloy constituents to form an aggregate and then grinding the aggregate to a powder state of desired particle size. It should be noted that prior fusing at elevated temperatures results in salt loss from the slag by volatilization, rendering the slag less fluid and more prone to fracturing.

The effectiveness of the slag in preventing or retarding the loss of magnesium from the cast iron melt depends on the thickness and continuity of the slag layer. I have found that slag in amounts of about 2% to 4% by weight of the cast iron melt provide adequate magnesium fade protection.

Thus, according to one aspect of my invention there is now provided a chloride salt-silicon containing composition comprising:

(a) from 20% to 95% by weight of a chloride salt containing at least one member selected from barium chloride and calcium chloride;

(b) from 5% to 80% by weight of silicon or a ferrosilicon base alloy with the ferrosilicon base alloy containing at least 10% by weight silicon, up to 25% by weight magnesium, up to 2% by weight of at least one member selected from aluminium and cerium or equivalent rare earths and the remainder essentially iron with the amount of silicon present in the ferrosilicon base alloy to provide at least 5% by weight silicon in the chloride salt-silicon containing composite.

In accordance with a more preferred aspect there is provided a chloride salt-silicon containing composition comprising:

(a) from 35% to less than 95% by weight of a salt containing at least one member selected from barium chloride and calcium chloride, and (b) at least 5% and up to 65% by weight silicon.

By an even more specific aspect of my invention there is now provided a chloride salt-silicon containing composite comprising:

(a) about 50% by weight of a salt composition containing at least one of the salts selected from barium chloride and calcium chloride, and (b) about 50% by weight of ferrosilicon base alloy containing about 50% by weight silicon, about 5% by weight magnesium, about 1% by weight aluminum, about 0.5% by weight cerium (or equivalent rare earths), and the remainder essentially iron.

By an even more preferred aspect of the present invention there is provided a slag composition which contains:

(a) 20% to 95% by weight of chloride salt containing at least one member selected from barium chloride and calcium chloride, (b) 5% to 65% by weight silicon (c) up to 20% by weight magnesium (d) up to 2% by weight of at least one member selected from aluminum and cerium (or equivalent rare earths), and (e) the remainder essentially iron.

For the purposes of illustration and not limitation a number of examples that are representative of my invention are presented in Tables 1, 2 and 3. The approximate composition of the cast iron used for the laboratory ingots given in Table 1 is as follows: 3.4% carbon, 3.1% silicon, 0.60% manganese, 0.01% sulfur, and 0.02% phosphorous with the remainder iron. In preparing these melts, approximately 4 grams of ferrosilicon containing magnesium and other inoculating agents were added to 100 grams of cast iron to give a resultant initial magnesium level of about 0.08% to 0.12% by weight. Following the inoculation operation the cast iron melts were covered with approximately 4 grams of the chloride salt-silicon alloy powder composite, held at various temperatures for various times and then cast into pyrex tube molds and solidified at approximately 20° C. per second. The cooling rate is in the chill rate range and would generally result in carbide formation in the absence of effective inoculation or loss of magnesium from the melt. Following casting the ingos were analyzed spectrographically for residual magnesium content and metallographically examined for nodularity of the graphite. The compositions for the inoculant alloys and slags referred to in Table 1 are provided in Table 2. A total of approximately 200 laboratory ingots were cast under various conditions and slags.

TABLE 1

Representative Laboratory Test Data (100gm melts)

| Ingot | Inoculant Alloy | Slag | Temp (°C.) | Time (Min) | Residual Mg (Wt %) | Nodularity (%) |
|---|---|---|---|---|---|---|
| A10 | I | none | 1500 | 0 | 0.086 | 90-100 |
| A13 | I | none | 1500 | 15 | 0.001 | 0 |
| YY3 | I | A | 1500 | 20 | 0.040 | 90-100 |
| YY63 | I | M | 1500 | 20 | 0.025 | 50-60 |
| YY71 | II | B | 1550 | 20 | 0.100 | 80-90 |
| YY72 | II | B | 1500 | 30 | 0.053 | 80-90 |
| YY74 | none | B | 1500 | 20 | 0.001 | 0 |
| YY96 | II | C | 1500 | 20 | 0.058 | 60-70 |
| YY97 | II | D | 1500 | 20 | 0.013 | 50-60 |
| YY98 | II | E | 1500 | 20 | 0.055 | 90-100 |
| YY104 | II | F | 1550 | 20 | 0.082 | 80-90 |
| YY107 | II | K | 1500 | 20 | 0.017 | 50-60 |
| YY108 | II | G | 1500 | 20 | 0.038 | 90-100 |
| YY111 | II | H | 1500 | 20 | 0.013 | 50-60 |
| YY113 | II | N | 1500 | 20 | 0.055 | 80-90 |
| YY127 | I | L | 1500 | 20 | 0.013 | 50-60 |
| YY128 | I | L | 1500 | 20 | 0.012 | 40-50 |

Approximate Compositions of Inoculant Alloys and Slags (wt %)

Alloy I: 47% Si, 47% Fe, 6% Mg, 0.3% Ce (or equivalent rare earths)
Alloy II: 51% Si, 42% Fe, 5% Mg, 1% Al, 1% Ca, 0.1% Ce (or equivalent rare earths)
Alloy III: 78% Si, 19% Fe, 1.5% Al, 1.5% Ca
Alloy IV: 10% Si, 90% Fe
Slag A: 50% $CaCl_2$, 50% Alloy I
Slag B: 50% $BaCl_2$, 50% Alloy II
Slag C: 20% $BaCl_2$, 80% Alloy I
Slag D: 25% $BaCl_2$, 25% $CaCl_2$, 25% Alloy I, 25% Alloy II
Slag E: 90% $BaCl_2$, 10% Alloy II
Slag F: 50% $BaCl_2$, 50% Alloy III
Slag G: 50% $BaCl_2$, 50% Si
Slag H: 95% $BaCl_2$, 5% Si
Slag K: 50% $BaCl_2$, 50% Alloy IV
Slag L: 50% $BaCl_2$, 50% SiC
Slag M: 32% $CaCl_2$, 25% $BaCl_2$, 43% Alloy II
Slag N: 30-40% $BaCl_2$, 60-70% Si (fused at 1530° C.)

The results of Table 1 show that the chloride salt-silicon alloy slag compositions and as defined by the subsequent claims significantly retard magnesium fade for holding periods up to 30 minutes and temperatures up to 1550° C. The residual magnesium level in the ingot is a more significant measure of the slag's effectiveness in retarding magnesium loss than nodularity, since the latter depends on other factors besides the magnesium level and is, moreover, only an estimate. A residual magnesium level of 0.1% to 0.015% and a nodularity of 50% to 60%, retained in a melt held for at least 20 minutes at 1450° C. and higher, are here considered to be the minimal conditions in determining the limits of the composition ranges for acceptable slags.

In a closer examination of the results, it should be noted the ingot A13 which had no slag cover lost virtually all of its magnesium within 15 minutes of inoculation. Ingot YY74 received no prior inoculation with magnesium but was covered with slag, and the absence of nodularity shows that the slag in itself has no effective nodularizing ability.

The results show that silicon may be present as elemental silicon (YY108) or as ferrosilicon (YY104), the ferrosilicon base alloy serving as a carrier for the silicon (and magnesium). Ingots YY96 and YY98 show that the slags are still effective in the 20% to 90% chloride salt range. Outside this range slag performance was too inconsistent, being either too viscous (less than 20% chloride salt) or too fluid with too little silicon (when ferrosilicon base alloy and more than 90% chloride salt is used).

The marginally low magnesium levels of ingots YY127 and YY128, despite the slag having the preferred levels of chloride salt and silicon content, indicates a possible breakdown of the slag due to the silicon carbide reaction as noted previously for example in reference to U.S. Pat. No. 3,704,230. Thus calcium silicide or silicon carbide should not be used as a silicon source for the slags, and if present in the ferrosilicon base alloy the levels should be low and ineffectual.

Figure 1B:
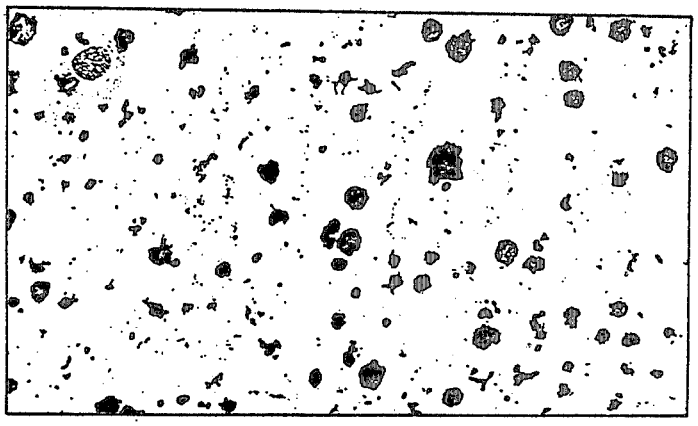
Figure 1C:
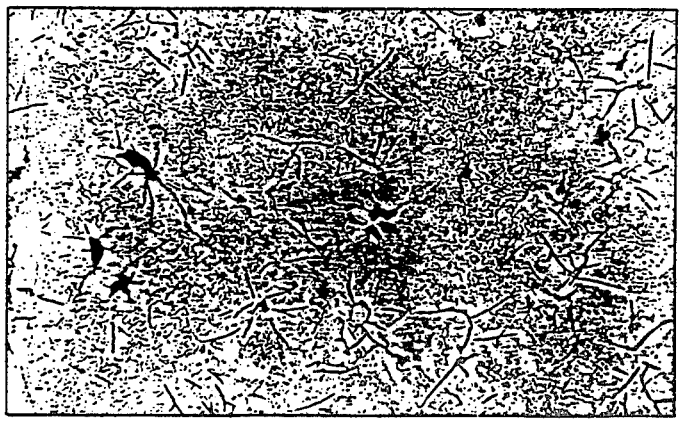

Attention may be had to the drawings wherein:

FIGS. 1*a*, 1*b* and 1*c* are photomicrographs of 100 magnification of three ingots showing varying degrees of nodularity. To assist in understanding these photomicrograhs the black regions are the graphite nodules or flakes.

FIG. 1*a* shows the microstructure of ingot YY3 of TABLE 1 employing the slag composite A of TABLE 2 clearly showing the nodular form of the graphite.

FIG. 1*b* shows the microstructure of ingot YY96 of TABLE 1 employing the slag composite C of TABLE 2 showing clearly nodularization had been effected.

FIG. 1*c* shows the microstructure of ingot A13 of TABLE 1 wherein no slag was employed and showing no nodular form of graphite.

There was little or no carbide phase evident in the microstructure.

Two slags were performance tested in foundries and the results are given in Table 3. The composition of the cast iron is approximately that used in the ingots of Table 1, and the quantity of cast iron melt used in each test was approximately 450 lbs (200 kg). Approximately 7–10 lbs of chloride salt-silicon containing composite powder was applied to the surface of the magnesium treated melts held in ladles. Melt samples were taken at the start and end of the holding period to determine the magnesium fade rate.

TABLE 3

| | | | Foundry Test Data (450 lb melts) | | | |
|---|---|---|---|---|---|---|
| Foundry | Ingot | Slag | Temp (°C.) | Time (Min) | Residual Mg(%) | Fade Rate (% min) |
| GW | GW0 | none | 1450 | 0 | 0.0393 | |
| | | | | 12 | 0.0267 | 0.0015 |
| | GW1 | G | 1450 | 0 | 0.0355 | |
| | | | | 18 | 0.030 | 0.00033 |
| | GW2 | P | 1450 | 0 | 0.042 | |
| | | | | 30 | 0.033 | 0.00030 |
| PB | PB0 | none | 1480 | 0 | 0.05 | |
| | | | | 19 | 0.02 | 0.0016 |
| | PB1 | P | 1460 | 0 | 0.05 | |
| | | | | 30 | 0.05 | 0.000 |
| | PB2 | P | 1460 | 0 | 0.04 | |
| | | | | 36 | 0.025 | 0.00042 |

Slag G: 50% $BaCl_2$, 50% Si
Slag P: 50% $BaCl_2$, 50% Alloy VI
Alloy VI: 65% Si, 28% Fe, 7% Mg The test results from Foundry GW show a decrease in the magnesium fade rate of approximately 75 to 80% when slag G or P is applied to the melt surface. In two tests of slag P in Foundry PB, ingot PB1 shows virtually no magnesium fade after a holding time of 30 minutes, and ingot PB2 shows a decrease of approximately 75% in the fade rate compared to the melt using no slag cover (PB0).

While this invention has been specifically illustrated and described with respect to certain preferred embodiments thereof, it should be understood that other embodiments can be construed from the teachings thereof without departing from the inventive concept defined by the claims.

The embodiments of the invention in which an exclusive property or privilege are claimed are defined as follows:

1. A chloride salt-silicon containing composite comprised of:

(a) from 20% to less than 90% by weight of a salt composition containing at least one of the salts selected from barium chloride and calcium chloride; and (b) more than 10% and up to 80% by weight of a ferrosilicon base alloy, said ferrosilicon base alloy containing at least 10% by weight silicon, up to 25% by weight magnesium, up to 2% by weight of at least one member selected from aluminum and cerium or equivalent rare earths, and the remainder essentially iron; the amount and silicon content of the ferrosilicon base alloy selected to give at least 5% by weight silicon in the said chloride salt-silicon containing composite.

2. The chloride salt-silicon containing composite of claim 1 wherein the said chloride salt is essentially barium chloride.

3. The chloride salt-silicon containing composite of claim 1 wherein the chloride salt is essentially calcium chloride.

4. The chloride salt-silicon containing composite of claim 1 comprised of:

(a) about 50% by weight of said chloride salt (b) about 50% by weight of said ferrosilicon base alloy containing about 50% by weight silicon, about 5% by weight magnesium, about 1% by weight aluminum, about 0.5% by weight cerium or equivalent rare earths, and the remainder essentially iron.

5. A chloride salt-silicon containing composite comprised of:

(a) from 35% to less than 95% by weight of a salt composition containing at least one of the salts selected from barium chloride and calcium chloride; and (b) at least 5% and up to 65% by weight silicon.

6. The chloride salt-silicon containing composite of claim 5 wherein the silicon contains up to 25% magnesium.

7. The chloride salt-silicon containing composite of claims 1 or 5 in powder form and prepared by mixing requisite amounts of said chloride salt powders and powders of said silicon containing materials.

8. The chloride salt-silicon containing composites of claims 1 or 5 fused at elevated temperatures to form homogeneous aggregates and grinding said aggregates to powders to desired particle size.

9. A slag containing:

(a) 20% to 95% by weight of chloride salt containing at least one member selected from barium chloride and calcium chloride, (b) 5% to 65% by weight silicon (c) up to 20% by weight magnesium (d) up to 2% by weight of at least one member selected from aluminum and cerium (or equivalent rare earths), and (e) the remainder essentially iron.

10. A method of preventing or retarding the loss of magnesium from magnesium-inoculated cast iron melts which comprises applying to the surface of said melt the chloride salt-silicon containing composite of claim 1 or claim 5.

* * * * *

UNITED STATES PATENT AND TRADEMARK OFFICE

CERTIFICATE OF CORRECTION

PATENT NO. : 4,224,070

DATED : September 23, 1980

INVENTOR(S) : WILLIAM V. YOUDELIS

It is certified that error appears in the above-identified patent and that said Letters Patent are hereby corrected as shown below:

In the heading, on page 1 of the patent, please insert the following:

Item [30] should read: Canadian Application No. 293,083 filed December 14, 1977.

Item [63] should read: Related U.S. Application Data. Continuation-in-Part of Serial No. 876,606 filed February 10, 1978.

Signed and Sealed this

Fourteenth Day of July 1981

[SEAL]

Attest:

GERALD J. MOSSINGHOFF

Attesting Officer

Commissioner of Patents and Trademarks